United States Patent [19]

Brown et al.

[11] 3,974,066

[45] Aug. 10, 1976

[54] REMOVAL OF OXYGEN FROM PETROLEUM CHARGE STOCKS

[75] Inventors: Kenneth M. Brown, Arlington Heights; Thomas A. Verachtert, Wheeling, both of Ill.

[73] Assignee: Universal Oil Products Company, Des Plaines, Ill.

[22] Filed: June 12, 1975

[21] Appl. No.: 586,330

[52] U.S. Cl. ..... 208/289; 208/295

[51] Int. Cl.[2] ..... C10G 29/04

[58] Field of Search ..... 208/288, 289, 295, 236, 208/177

[56] References Cited

UNITED STATES PATENTS

| | | | |
|---|---|---|---|
| 2,921,020 | 1/1960 | Urban et al. | 208/288 |
| 3,154,483 | 10/1964 | Urban | 208/288 |
| 3,260,665 | 7/1966 | Urban | 208/288 |

*Primary Examiner*—G. J. Crasanakis

*Attorney, Agent, or Firm*—James R. Hoatson, Jr.; Raymond H. Nelson; William H. Page, II

[57] ABSTRACT

A method is disclosed for the treatment of a petroleum charge stock which comprises the treatment of said petroleum charge stock with an aqueous solution containing a metal phthalocyanine compound and a compound selected from the group consisting of an alkali metal sulfide and an alkali metal sulfite.

12 Claims, No Drawings

REMOVAL OF OXYGEN FROM PETROLEUM CHARGE STOCKS

This invention relates to a method for the removal of oxygen from a petroleum charge stock. More specifically, this invention relates to a method for the removal of oxygen from a petroleum charge stock which comprises the treatment of said charge stock with an aqueous solution containing a metal phthalocyanine compound and a compound selected from the group consisting of an alkali sulfide and an alkali sulfite.

The treatment of petroleum charge stocks is well-known in the prior art. It has been shown in the prior art that various petroleum charge stocks have been treated with various compounds to remove oxidizing agents therefrom. Hydrazines have been utilized to remove oxygen from petroleum charge stocks, however, such a procedure is considered economically impractical as a result of the high cost of various hydrazines. Sodium sulfite and sodium sulfide have been shown as additives, however, the preparation of sodium sulfite involves an added expense and the reaction of sodium sulfide is regarded as too slow to effectuate oxygen removal.

In contradistinction to the prior art it has now been discovered that an alkali sulfide or an alkali sulfite may be utilized in the method of this invention where a metal phthalocyanine compound is added to augment the oxygen removal from the charge stock. Oxygen will readily react with hydrogen sulfide released by decomposition of sulfur compounds during various crude oil processing such as crude oil distillation in accordance with the well-known reaction:

$$2H_2S + O_2 \rightarrow 2S^o + 2H_2O$$

The basic reaction will proceed in an acidic environment or in a mildly basic environment at a pH of up to 8 or 8.5, in the upper portion of a crude distillation column to create problems of elemental sulfur formation. One method to prevent the elemental sulfur formation is to inject a volatile base such as ammonia or morpholine or other volatile basic organic nitrogen compounds to provide a basic environment, however, such an environment is undesirable as a result of corrosion protection problems. The utilization of the present invention will allow a crude distillation in an acidic environment in the overhead system without the problem of elemental sulfur formation as a result in the elimination of oxygen from the crude feedstock. The method of the present invention will also result in a more effective oxygen removal from the petroleum charge stock. The additional cost of catalyst charged to the petroleum charge stock will be small and the cost of the method of the present invention will be lower than the other technically feasible methods known to the art. Additionally, the catalytic method of the present invention will allow the petroleum refiner to utilize an alkali sulfide, in particular sodium sulfide, for the removal of oxygen, and sodium sulfide generally being available at all refineries in the form of a spent caustic which has been used to remove hydrogen sulfide from other petroleum products. The utilization of the present invention is couched in the fact that a petroleum charge stock which is oxygen-free is greatly beneficial to petroleum refiners as a result of alleviating the problem of further oxidation from within the petroleum charge stock which would produce sulfur and other undesirable effects such as sediments and color-generating materials. The oxygen-free petroleum charge stock may be utilized in various manners or processes by the petroleum refiner in contrast to the oxygen-containing charge stocks which present oxygen-removal problems.

Therefore, it is an object of this invention to provide a process for the removal of oxygen from a petroleum charge stock.

Further, it is an object of this invention to provide a method for the removal of oxygen from a petroleum charge stock in a more feasibly economical method utilizing certain catalytic compositions of matter.

In one aspect an embodiment of this invention resides in a method for the removal of oxygen from a petroleum charge stock which comprises the treatment of said petroleum charge stock with an aqueous solution containing a metal phthalocyanine compound and a compound selected from the group consisting of an alkali sulfide and an alkali sulfite at treatment conditions, and recovering the resultant oxygen-free petroleum charge stock.

A specific embodiment of this invention resides in a process for the treatment of a petroleum charge stock comprising a crude oil and oxygen which comprises the addition of an aqueous solution containing cobalt phthalocyanine and sodium sulfite at a temperature of from about 0° to about 200° C. and a pressure of about 1 atmosphere to effect the removal of oxygen from the petroleum charge stock.

A second specific embodiment of the present invention resides in a method for the removal of oxygen from a petroleum charge stock comprising crude oil and oxygen which comprises the addition to said petroleum charge stock of an aqueous solution containing vanadium phthalocyanine and an alkali sulfite at a temperature of 100° C. and a pressure of about 1 atmosphere to effect the removal of the oxygen from the petroleum charge stock, and recovering the resultant oxygen-free petroleum charge stock.

Other embodiments and objects of the present invention encompass details about the reaction conditions, types of petroleum charge stocks, types of metal phthalocyanine catalysts, types of alkali sulfides, types of alkali sulfites, weight percentage ranges of various metal phthalocyanine compounds and weight percentage of various alkali sulfites or sulfides.

As hereinbefore set forth the present invention is concerned with the removal of oxygen from a petroleum charge stock which comprises the treatment of said petroleum charge stock with an aqueous solution containing a metal phthalocyanine compound and a compound selected from the group consisting of an alkali sulfide and an alkali sulfite at treatment conditions. The treatment conditions of the present invention will include a temperature of from about 0° to about 250° C. and preferably from about 25° to about 200° C. The treatment conditions also include a pressure from about 1 atmosphere to about 100 atmospheres. When superatmospheric pressures are employed, said pressures may be afforded by the introduction of the aqueous solution under a nitrogen pressure or a pressure exerted by any other substantially inert gas.

Examples of the types of petroleum charge stocks which may be utilized in the present invention for the removal of oxygen therefrom will comprise all petroleum charge stocks possessing a specific gravity of from about 0.780 to about 0.970. It is contemplated within the scope of this invention that oxygen may be removed from any petroleum charge stock within the above set forth specific gravity range such as gasoline, naphtha, kerosine, fuel oil, gas oil, lubricating oil, paraffin wax, asphalt and coke. Types of alkali sulfides which may be used in the aqueous solution of the present invention will comprise quaternary alkyl ammonium sulfide, such as tetraamyl ammonium sulfide, tetraethyl ammonium sulfide, tetrahexyl ammonium sulfide, tetrabutyl ammonium sulfide, tetradecyl ammonium sulfide, or ammonium sulfide, or sodium sulfide, potassium sulfide, rubidium sulfide, cesium sulfide or francium sulfide and examples of the types of alkali sulfites which may be utilized in the present invention will include quaternary alkyl ammonium sulfite, such as tetraamyl ammonium sulfite, tetrahexyl ammonium sulfite, tetraethyl ammonium sulfite, tetrabutyl ammonium sulfite, tetradecyl ammonium sulfite, or ammonium sulfite, or sodium sulfite, potassium sulfite, rubidium sulfite, cesium sulfite and francium sulfite. Metal phthalocyanine compounds which are utilized as catalysts in the present invention will include cobalt and vanadium phthalocyanine. Other metal phthalocyanines which may also be used although not necessarily with equivalent results will include iron, nickel, copper, molybdenum, manganese, tungsten and the like. Any suitable derivative of the metal phthalocyanine compound may be employed which may include the sulfonated derivatives and the carboxylated derivatives. For example, cobalt phthalocyanine may be either monosulfonated, disulfonated or tetrasulfonated or the vanadium phthalocyanine may be carboxylated or monosulfonated, disulfonated or tetrasulfonated.

It is to be understood that the aforementioned types of metal phthalocyanine compounds, types of petroleum charge stocks, types of alkali sulfides and types of alkali sulfites are only representative of the class of compounds which may be emloyed, and that the present invention is not limited thereto.

The aqueous solution which is charged to the petroleum charge stock containing oxygen will contain a metal phthalocyanine compound and a compound selected from the group consisting of an alkali sulfide and alkali sulfite. The metal phthalocyanine compound is present in the alkali sulfide or alkali sulfite solution in a range of from about 0.10 parts per million to about 300.00 parts per million, or in excess of the 300.00 parts per million, however, the excess is not considered economically feasible for the oxygen removal in the method of this invention. The solution will contain the alkali sulfide or alkali sulfite compound in a mole ratio of from about 1 wt. percent to about 10 wt. percent alkali sulfide or alkali sulfite per weight percent of water in the aqueous solution. Therefore, the aqueous solution will contain from about 99.0 wt. percent water to about 90 wt. percent water.

The process of this invention may be effected in any suitable manner and may comprise either a batch or a continuous type operation, however, the continuous type operation is the preferred mode of operation. When the continuous method of operation is utilized a petroleum charge stock containing oxygen is continuously passed through an enclosure equipped with a t-joint for the addition of the aqueous solution. The aqueous solution containing the metal phthalocyanine compound and a compound selected from the group consisting of an alkali sulfide or an alkali sulfite may be added through the t-joint under pressure or at atmospheric conditions to freely mix with the crude oil to effect the removal of the oxygen. It should be noted that the oxygen is removed by the reaction of the alkali sulfide or alkali sulfite to form the alkali thiosulfate or alkali sulfate respectively. For example, when sodium sulfide is charged to the petroleum charge stock containing oxygen the sodium sulfide is catalytically reacted with the oxygen to form sodium thiosulfate which will not oxidize any residual hydrogen sulfide formed in various other petroleum refinery procedures. Alternatively, the cobalt phthalocyanine and compounds selected from the group consisting of alkali sulfide or alkali sulfite may be charged to the petroleum charge stock in any manner known to the art such as a slurry or countercurrent addition method. It should be noted that the alkali thiosulfate which is produced from the reaction of the oxygen with the alkali sulfide or alkali sulfite presents no problems of disposal or contamination of the petroleum charge stock.

The following examples are given to illustrate the method of the present invention which, however, are not intended to limit the generally broad scope of the present invention.

EXAMPLE I

In this example a petroleum crude oil charge stock possessing a specific gravity of 0.850 is treated with oxygen so as to insure a sufficient entrainment of the oxygen in the charge stock. The charge stock containing the oxygen is transferred to a container to which a solution comprising 1.00 ppm cobalt phthalocyanine disulfonate, 5.0 weight percent sodium sulfide and 94.9 weight percent water. The aqueous solution is allowed to mix with the oxygen-containing charge stock for a period of time comprising 1 hour at a temperature of about 55° C. and a pressure of 1 atmosphere. After the 1 hour period of time the petroleum crude oil charge stock is recovered by withdrawal of the aqueous phase and charged to a second vessel containing a gaseous stream of substantially pure hydrogen sulfide. The charge stock is thoroughly mixed with the hydrogen sulfide for a period of time comprising 1 hour at ambient conditions of pressure and temperature. After the 1 hour period of time the petroleum fraction is withdrawn and analyzed for elemental sulfur. The analysis discloses an absence of elemental sulfur which shows that no oxidizing agents, oxygen in particular, is present in the petroleum charge stock after treatment with the aqueous solution.

EXAMPLE II

In this example a petroleum crude oil charge stock possessing a specific gravity of 0.950 is treated with oxygen so as to insure a sufficient entrainment of the oxygen in the charge stock. The charge stock containing oxygen is transferred to a container to which a solution comprising 2.50 ppm vanadium tetrasulfonate, 6.0 weight percent sodium sulfite and approximately 93.7 weight percent water. The aqueous solution is vigorously mixed with the oxygen-containing petroleum charge stock for a period of time comprising 0.5 hours at a temperature of 150° C. and a pressure of 1 atmosphere. After the 0.5 hour period of time the petroleum charge stock is removed from the container and analyzed for oxygen and the resultant aqueous solution is analyzed for sulfate. The analysis discloses the product to be substantially oxygen-free and the separated aqueous solution to contain an amount of sodium thiosulfate chemically equivalent to the amount of oxygen converted by the catalytic reaction.

EXAMPLE III

In this example a petroleum crude oil charge stock possessing a specific gravity of 0.790 is treated with oxygen so as to insure a sufficient entrainment of the oxygen and the petroleum charge stock. The charge stock containing oxygen is transferred to a container to which a solution comprising 1.00 ppm manganese monosulfonate, 2.5 weight percent potassium sulfide and 97.4 weight percent water. The aqueous solution is vigorously mixed with the oxygen-containing charge stock for a period of time comprising 0.7 hours at a temperature of 200° C. and a pressure of 5 atmospheres as afforded by the introduction of substantially inert nitrogen gas. After the 0.7 hour period of time the petroleum charge stock is removed from the container and analyzed for oxygen and the aqueous solution for thiosulfate content. The analysis discloses the product to be substantially oxygen-free and the treated aqueous solution to contain an amount of potassium thiosulfate substantially chemically equivalent to the amount of oxygen converted by the catalytic reaction. The above set forth example was repeated utilizing potassium sulfite in place of the potassium sulfide, said analysis again disclosing the equivalent presence of potassium thiosulfate and a substantially oxygen-free treated petroleum charge stock.

We claim as our invention:

1. A method for the removal of oxygen from a petroleum charge stock which comprises treating said petroleum charge stock with an aqueous solution containing a metal phthalocyanine compound and a compound selected from the group consisting of an alkali metal sulfide and an alkali metal sulfite at aqueous treating conditions, and separating said aqueous solution from the resultant oxygen-free petroleum charge stock.

2. The method of claim 1 further characterized in that said treating conditions include a temperature of from about 0° to about 250° C. and a pressure of from about 1 atmosphere to about 100 atmospheres.

3. The method of claim 1 further characterized in that the petroleum charge stock comprises crude oil possessing a specific gravity of from about 0.780 to about 0.970.

4. The method of claim 1 further characterized in that the metal phthalocyanine is cobalt phthalocyanine.

5. The method of claim 1 further characterized in that the metal phthalocyanine is vanadium phthalocyanine.

6. The method of claim 1 further characterized in that the metal phthalocyanine is manganese phthalocyanine.

7. The method of claim 1 further characterized in that the metal phthalocyanine is present in the range of from about 0.10 ppm to about 300 ppm.

8. The method of claim 1 further characterized in that the alkali metal sulfide is sodium sulfide.

9. The method of claim 1 further characterized in that the alkali metal sulfide is potassium sulfide.

10. The method of claim 1 further characterized in that the alkali metal sulfite is sodium sulfite.

11. The method of claim 1 further characterized in that the alkali metal sulfite is potassium sulfite.

12. The method of claim 1 further characterized in that the alkali metal sulfide or alkali metal sulfite is present in said aqueous solution in about 1 to about 10 weight percent.

* * * * *